US008522451B2

(12) United States Patent
Chernetski et al.

(10) Patent No.: US 8,522,451 B2
(45) Date of Patent: Sep. 3, 2013

(54) METHOD FOR SPRAYING TREATING CHEMISTRY IN A DISPENSING DRYER

(75) Inventors: Fredrick E. Chernetski, Saint Joseph, MI (US); Michael T. Dalton, Saint Joseph, MI (US); Joel Adam Luckman, Benton Harbor, MI (US); Karl D. McAllister, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 531 days.

(21) Appl. No.: 12/489,516

(22) Filed: Jun. 23, 2009

(65) Prior Publication Data

US 2010/0000113 A1 Jan. 7, 2010

Related U.S. Application Data

(60) Provisional application No. 61/077,506, filed on Jul. 2, 2008.

(51) Int. Cl.
*F26B 7/00* (2006.01)
*F26B 21/06* (2006.01)

(52) U.S. Cl.
USPC ..... 34/380; 34/390; 34/541

(58) Field of Classification Search
USPC ..... 34/389, 390, 541, 585, 638, 380
See application file for complete search history.

(56) References Cited

U.S. PATENT DOCUMENTS

| | | | | |
|---|---|---|---|---|
| 7,059,065 | B2 | 6/2006 | Gerlach et al. | |
| 7,117,613 | B2 | 10/2006 | Guinibert et al. | |
| 7,325,330 | B2 * | 2/2008 | Kim et al. | 34/407 |
| 2006/0005581 | A1 | 1/2006 | Banba | |
| 2007/0227030 | A1 | 10/2007 | Oh et al. | |

FOREIGN PATENT DOCUMENTS

| | | | |
|---|---|---|---|
| DE | 19948622 | A1 | 5/2000 |
| EP | 0347393 | A2 | 12/1989 |
| EP | 0483909 | A1 | 5/1992 |
| EP | 0554194 | A1 | 8/1993 |
| EP | 1798323 | A1 | 6/2007 |
| EP | 1813705 | A1 * | 8/2007 |
| JP | 2274294 | A | 11/1990 |
| WO | 2006/101358 | A1 | 9/2006 |

* cited by examiner

*Primary Examiner* — Kenneth Rinehart
*Assistant Examiner* — John McCormack
(74) *Attorney, Agent, or Firm* — Clifton G. Green; McGarry Bair PC

(57) ABSTRACT

A method of spraying a treating chemistry into a dispensing dryer in a manner to avoid the pooling and dripping of the treating chemistry.

24 Claims, 3 Drawing Sheets

METHOD FOR SPRAYING TREATING CHEMISTRY IN A DISPENSING DRYER

CROSS-REFERENCE TO RELATED APPLICATIONS

This application claims priority from U.S. Provisional Application No. 61/077,506 filed on Jul. 2, 2008, entitled A METHOD FOR SPRAYING TREATING CHEMISTRY IN A DISPENSING DRYER hereby incorporated by reference.

BACKGROUND OF THE INVENTION

A clothes dryer may be provided with a dispensing system by which it may dispense a treating chemistry onto a load of laundry during a drying cycle of operation. This type of dryer may be referred to as a dispensing dryer. The treating chemistry may be any chemistry applied to the laundry such as water, bleach, perfume, softener, stain guard, anti-wrinkling or the like. Spraying by various means may be used to deliver the treating chemistry from a dispensing system to the drying chamber.

SUMMARY OF THE INVENTION

A method of spraying a treating chemistry into a dispensing dryer in a manner to avoid pooling and dripping of the treating chemistry.

DESCRIPTION OF THE EMBODIMENTS OF THE INVENTION

Figure 1:
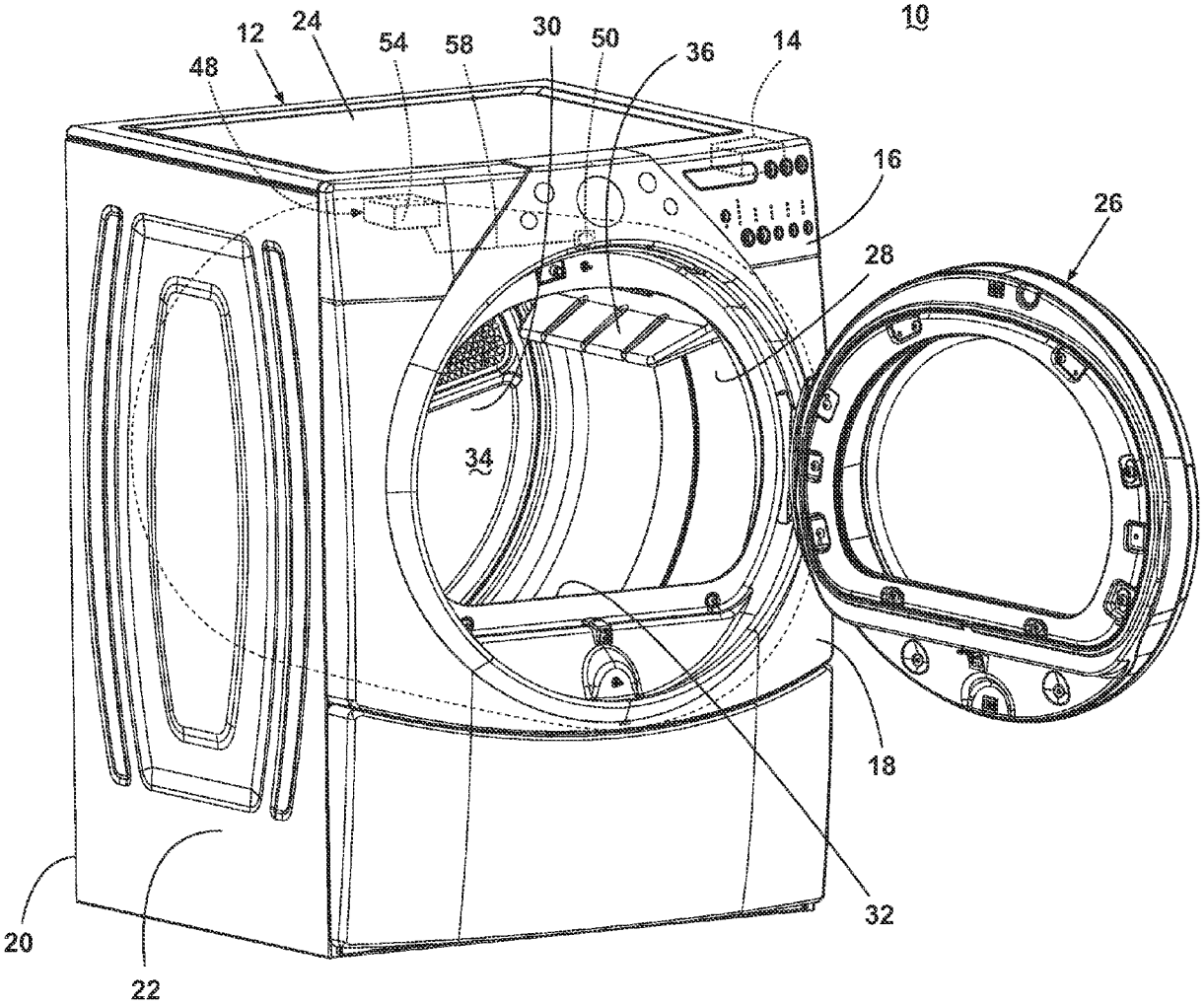
FIG. 1 is a front perspective view of a dispensing dryer according to one embodiment of the invention.

FIG. 1 illustrates one embodiment of a dispensing dryer 10 according to the invention. The dispensing dryer 10 described herein shares many features of a traditional automatic clothes dryer, and will not be described in detail except as necessary for a complete understanding of the invention. Although the dispensing dryer 10 may be illustrated as a front-loading dryer, the dispensing dryer may also be a top-loading dryer, as well as a combination washing machine and dryer; a tumbling or stationary refreshing/revitalizing machine; an extractor; a non-aqueous washing apparatus; and a revitalizing machine.

The dispensing dryer 10 may be illustrated comprising a cabinet 12 in which is provided a controller 14 that may receive input from a user through a user interface 16 for selecting a cycle of operation and controlling the operation of the dispensing dryer 10 to implement the selected cycle of operation. The cabinet 12 may be defined by a front wall 18, a rear wall 20, and a pair of side walls 22 supporting a top wall 24. A door 26 may be hingedly mounted to the front wall 18 and may be selectively moveable between opened and closed positions to close an opening in the front wall 18, which provides access to the interior of the cabinet.

A rotatable drum 28 may be disposed within the interior of the cabinet 12 between opposing stationary rear and front bulkheads 30 and 32, which collectively define a drying chamber 34, for drying laundry, having an open face that is selectively closed by the door 26. Examples of laundry include, but are not limited to, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be dried in the dispensing dryer 10.

The drum 28 may be in the form of a rotatable cylinder having rear and front edges that may be received within sealed channels of the rear and front bulkheads 30 and 32. The front bulkhead 32 may have an opening that aligns with the open face of the front wall 18. The drum 28 may have a circumference larger than that of the door 26 such that part of the front bulkhead 32 covers a portion of the front face of the drum 28. Thus, when the door 26 may be in a closed position, it closes the face of the cabinet 12 and not the entire face of the drum 28. However, the drum 28 may be considered to be closed when the door 26 is in the closed position.

The drum 28 may further include at least one baffle 36. In most dryers, there are multiple baffles. The baffles 36 can be located along the inner surface of the drum 28 defining an interior circumference of the drum 28. The baffles 36 can be oriented generally parallel to a rotational axis of the drum 28. The baffles 36 facilitate the tumbling action of the fabric load within the drum 28 as the drum 28 rotates about the rotational axis. Typically, there are three baffles 36 located on the drum 28 and equally spaced about the circumference of the drum.

Figure 2:
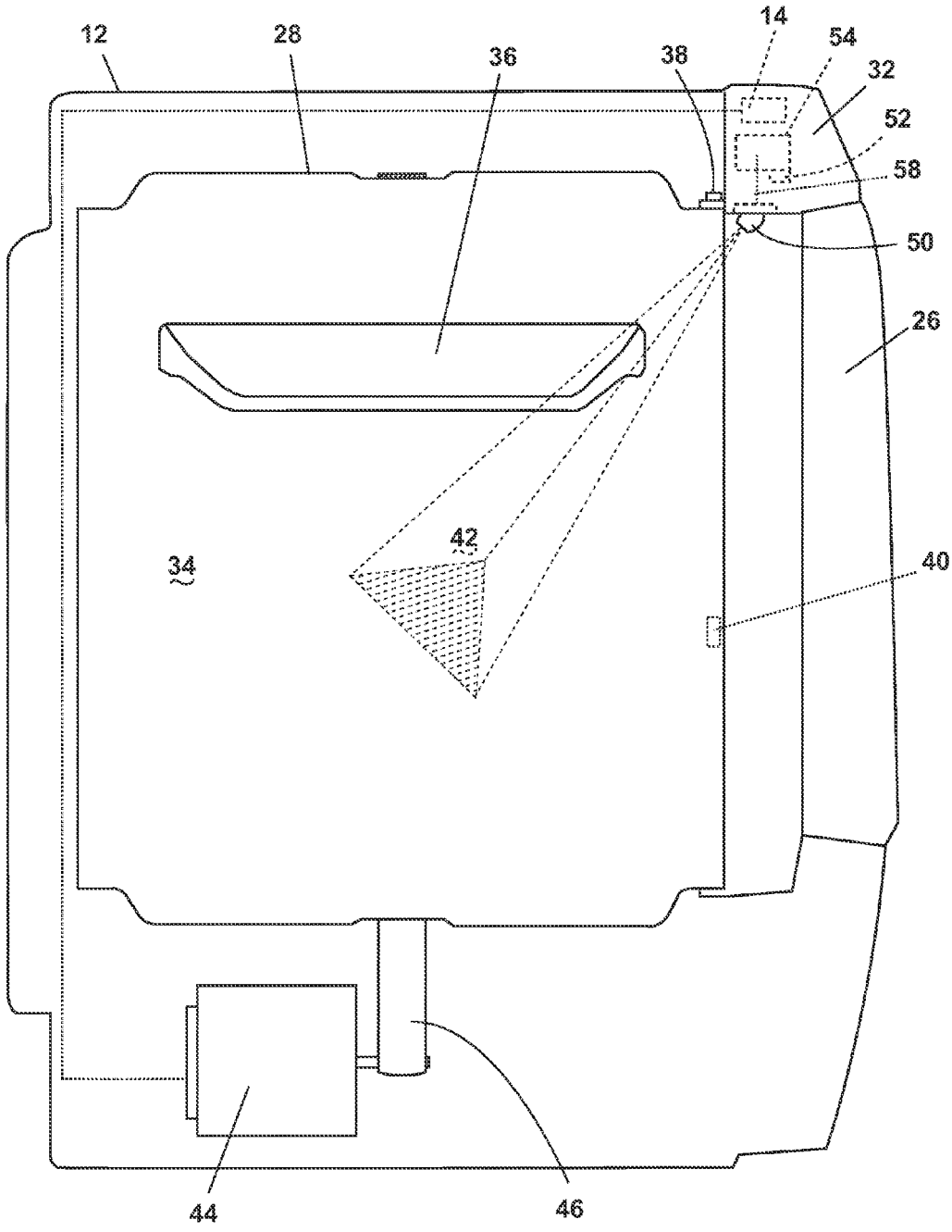
FIG. 2 is a cross-sectional, schematic side view of a dispensing dryer according to the embodiment of the invention of FIG. 1.

As shown in FIG. 2, the dispensing dryer 10 may also have a drum stop, which may also be referred to as a drum alignment mechanism that stops the drum at a predetermined rotational position. A variety of drum stops may be used. One exemplary drum stop comprises a position sensor in the form of optical sensor 38 and a corresponding indicia, such as a black mark 40 or plurality of black marks. The optical sensor 38 may be located on either of the rear or front bulkhead 30, 32 and the black mark 40, or plurality of black marks, may be located on the outer circumference of the drum 28. The optical sensor 38 is operably coupled to the controller 14, such that the optical sensor outputs to the controller 14 information that may directly or indirectly indicate the rotational position of the drum.

The number of black marks 40 and sensors 38 may be adjusted as desired to obtain the desired control. For example, one black mark 40 may be used to define a single position of the drum relative to the sensor 38. Multiple black marks 40 may be used to provide greater resolution to the location of the drum relative to the sensor. For example, a black mark be located at each baffle to indicate the position of the baffle. In such cases, it may be useful to know when a baffle is approaching the sensor 38 and has passed the sensor 38. Thus, the black mark 38 may span the radial width of the baffle or a black mark may radially precede and follow the baffle. Optionally, more sensors 38, may be spaced about the drum 28 to sense the current position of the black mark 40. In most cases, it will be more cost effective to use more black marks 40 than sensors 38.

As is typical in a clothes dryer, the drum 28 may be rotated by a motor 44 and a coupled belt 46. The controller 14, which may be operably coupled to the motor 44, may use the information from the sensor 38 in combination with controlling the motor 44 to control the rotation of the drum 28 until the drum 28 is in a desired position. It may be readily understood that the location of the sensor 38 and mark 40 may be in numerous other locations. Other exemplary position sensors include magnetic switches, motor position sensors, or magnetic sensors.

The dispensing dryer 10 may have a dispensing system 48 for dispensing treating chemistries, including water, into the drying chamber 34. The dispensing system 48 may include a reservoir 54 capable of holding treating chemistry and a dispenser 50 that fluidly couples the reservoir 54 through a dispensing line 58. The treating chemistry may be delivered to the dispenser 50 from the reservoir 54 and the dispenser 50 may dispense the chemistry into the drying chamber 34. A chemistry meter 52 may electronically couple, wired or wirelessly, to the controller 14 to control the amount of treating chemistry dispensed.

The type of dispenser 50 is not germane to the invention. Any suitable dispenser will work. The dispenser 50 may be a rigid nozzle or may be a flexible nozzle constructed of a material such as silicone or polyethylene. It may be readily understood that the type of dispenser and the number of dispensers may be changed. For example, there may be any number of nozzles positioned to direct the chemistry into the drying chamber 34. In addition to nozzles, other types of dispensers may be used, such as misters, nebulizers, steamers, or any other outlet that produces a spray. The dispenser 50 may dispense the chemistry as a continuous stream, a mist, an intermittent stream, or various other spray patterns.

The dispenser 50 may be mounted above the door 26 at the front of the drum 28 on the front bulkhead 32. This is just one contemplated location for the dispenser 50, and other locations may be feasible. Alternatively, the dispenser 50 may be mounted at the back of the drum 28 on the rear bulkhead 30. It may be readily understood that the position of the dispenser 50 may be changed as long as the dispenser 50 may be able to direct the treating chemistry at the inner surface of the drum 28 so that laundry may contact and absorb the chemistry, or so that the dispenser 50 may dispense the chemistry directly onto the laundry in the drying chamber 34.

The dispenser 50 emits treating chemistry in a known pattern for the particular type of dispenser. The known pattern may be referred to as spray zone 60. The spray zone 60 is defined as the three dimensional pattern in which the treating chemistry is sprayed out of the dispenser 50 nozzle. The spray zone 60 does not include any particle drift that occurs in a time period subsequent to the initial spray of the treating chemistry. Particle drift is a function of fine droplets of treating chemistry suspended in air and being carried by air currents or being pulled downward by gravity, resulting in droplets that appear as a haze outside the spray zone 60.

The previously described dispensing dryer 10 provides the structure necessary for the implementation of the method of the invention. Several embodiments of the method will now be described in terms of the operation of dispensing dryer 10. The embodiments of the method function to retard or prevent the collecting or pooling of treating chemistry on structure within the drying chamber to avoid having the collected or pooled treating chemistry from forming droplets that may drip on the laundry. The dripping of the treating chemistry is undesirable as it leads to uneven distribution of the treating chemistry, but having localized high density spots. Depending on the treating chemistry and laundry, the droplets may cause uneven drying or staining.

Figure 3:
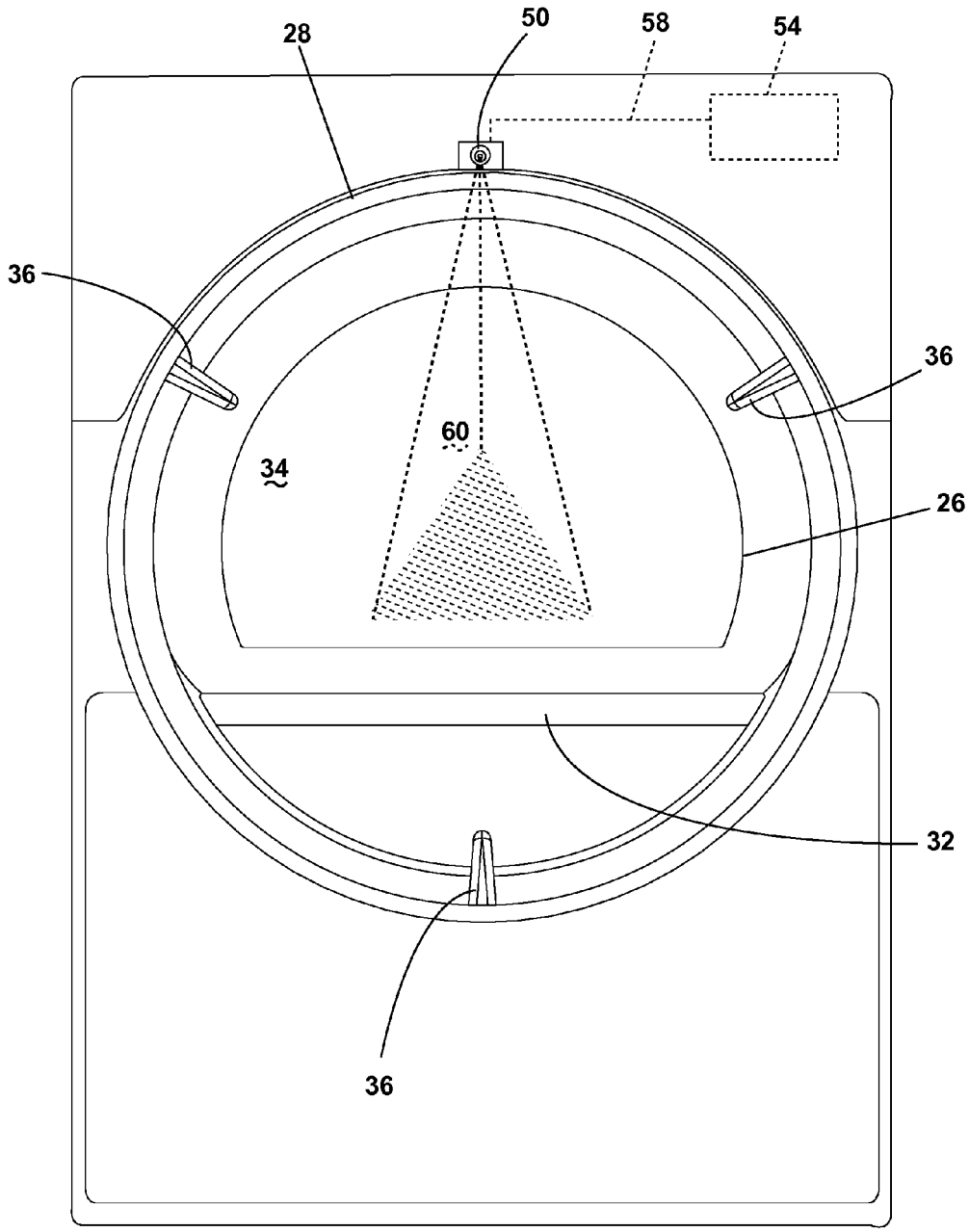
FIG. 3 a cross-sectional, schematic rear view of a dispensing dryer according to the embodiment of the invention of FIG. 1.

The general approach of the method to avoid the dripping is to configure the dispensing dryer 10 not to spray treating chemistry directly on the door 26 (see FIG. 2) and/or baffles 36 (see FIG. 3). This can be accomplished by controlling the spray zone for the dispenser 50, which is more effective for the door, which does not move, than for the baffles, which may move into and out of the spray zone depending on the relative location of the baffles 36 and dispenser 50, along with the size and shape of the spray zone. The spraying of the treating chemistry through the dispenser may be controlled in such a way to avoid directly spraying the baffles 36.

It should be noted that in some cases the direct spraying of the baffles may not be a concern. When the baffles are located in the lower part of the chamber and are being covered or passed over by the tumbling laundry, the nature of the tumbling action of the laundry further tends to retard or prevent the pooling of the treating chemistry. As the laundry tumbles in the drying chamber, it may effectively wipe the surfaces of the entire drying chamber 34, helping to prevent pooling of the treating chemistry. Thus, a greater concern exists for direct spraying of the baffles 36 when they are not subject to the tumbling laundry.

The embodiments of the method described below may take place during any portion of a cycle of operation of the dispensing dryer that requires the dispensing of treating chemistry. For example, it may be a drying cycle that includes a treating cycle or it may be a stand alone treating cycle, with or without drying.

Referring to FIG. 3, according to a first embodiment of the method, treating chemistry may be dispensed into the drying chamber 34 while the drum 28 is stopped. In order to avoid spraying treating chemistry on either of the at least one baffle 36 or the door 26, the drum 28 may be stopped at one, or a choice of several, predetermined positions. The predetermined position is chosen so as to locate the baffles 36 outside of the spray zone 60. The positioning of the drum 28 may be accomplished through various methods of detecting a position and accordingly stopping the rotation of the drum 28. Once the drum 28 has stopped rotating and is located in the predetermined position, spraying of the treating chemistry may commence in order to treat the laundry. The spraying step may be one continuous dispensing of the treating chemistry, or may be multiple discrete sprayings of the treating chemistry.

The spraying of the treating chemistry may while the drum is stopped may be done one or multiple times. For example, the drum may be stopped, followed by a spraying. After the spraying, the drum may be rotated to a new position, then stopped, and followed by another spraying. The repeating of the rotating, stopping, spraying, rotating may be done any number of times. The rotating between the stops may be a partial rotation of the drum, a full rotation of the drum, or more than a full rotation, including multiple rotations. It may be done at any speed, and may include varying the speed.

Alternatively, in a second embodiment of the method, the drum 28 may continue rotating during the spraying of the treating chemistry. In order to avoid spraying the rotating baffles 36, the spraying step may comprise one or multiple discrete sprayings of the treating chemistry that are sequenced with the rotation of the drum to avoid directly spraying the baffles. This requires that the position of the drum 28 be monitored by the sensor 38 and communicated to the controller 14 regarding the location of the baffles 36. The spraying will be conducted when the baffles 36 are in a predetermined position, which is any position outside of the spray zone 60. The spray step in the second embodiment may be a pulsating spray and may be relative to the rate of rotation of the drum 28. The sequencing or timing of the spray to the drum may be effected by using the rotational control previously described While avoiding directly spraying any portion of the baffle 36 will retard or eliminate the pooling of the treating chemistry, avoiding directly spraying the edge of the baffle 36 closest to the dispenser 50 will, with most dryer configurations, provide the greatest benefit because the edge closest to the dispenser 50 presents a smaller surface area over which the chemistry may spread and the volume of per unit area of the chemistry is greater the closer to the dispenser 50.

In a third embodiment of the method, the method involves controlling the position and size of the spray zone 60 to avoid directly spraying on the door 26 as best seen in FIG. 2. This method may also be applied to the baffles 36. That is the position and size of the spray zone may be controlled to prevent the baffles from intersecting the spray zone.

The application of the third embodiment as applied to the baffles is more effective when it is combined with either of the first or second embodiments of the method. That is, controlling the position and size of the spray zone may be combined with controlling the rotation of the drum, including the stopping of the drum, during the spraying to ensure that the baffles are not in the spray zone. In this way, all of the embodiments may be mixed and matched as desired While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method for dispensing a treating chemistry in a dispensing dryer comprising a rotatable drum partially defining a treating chamber and having at least one baffle for lifting laundry during rotation of the drum, a door providing selective access to the treating chamber, and a dispensing system having a nozzle for spraying a treating chemistry into the treating chamber to define a spray zone within the treating chamber, the method comprising:

determining a rotational position of the at least one baffle; and spraying the treating chemistry based on the determined rotational position.

2. The method according to claim 1 wherein the drum is not rotated during the spraying of the treating chemistry.

3. The method according to claim 1 wherein the drum is rotated during the spraying of the treating chemistry.

4. The method according to claim 3 wherein the spraying step comprises multiple discrete sprayings of the treating chemistry.

5. The method according to claim 1 wherein the spraying step comprises multiple discrete sprayings of the treating chemistry without rotation of the drum.

6. The method according to claim 5 further comprising rotating the drum between each of the multiple discrete sprayings.

7. The method according to claim 1 wherein the drum comprises multiple baffles.

8. The method according to claim 1 wherein the door lies outside the defined spray zone.

9. A method for dispensing a treating chemistry in a dispensing dryer comprising a rotatable drum partially defining a treating chamber and having at least one baffle for lifting laundry during rotation of the drum, a door providing selective access to the treating chamber, and a dispensing system having a nozzle for spraying a treating chemistry into the treating chamber to define a spray zone within the treating chamber, the method comprising:

providing the at least one baffle in the drum at a location such that rotation of the drum defines a rotational path of the at least one baffle;

determining a rotational position of the at least one baffle; and spraying the treating chemistry into the defined spray zone based on the determined rotational position to limit pooling of the treating chemistry on the at least one baffle and prevent dripping of the treating chemistry from the at least one baffle.

10. The method according to claim 9 wherein the drum is not rotated during the spraying of the treating chemistry.

11. The method according to claim 9 wherein the drum is rotated during the spraying of the treating chemistry.

12. The method according to claim 9 wherein the spraying step comprises multiple discrete sprayings of the treating chemistry without rotation of the drum.

13. The method according to claim 12 further comprising rotating the drum between each of the multiple discrete sprayings.

14. The method according to claim 9 wherein the spraying step further comprises spraying the treating chemistry into the treating chamber to limit pooling of the treating chemistry on the door and prevent dripping of the treating chemistry from the door.

15. A method for dispensing a treating chemistry in a dispensing dryer comprising a rotatable drum partially defining a treating chamber and having at least one baffle for lifting laundry during rotation of the drum, a door providing selective access to the treating chamber, and a dispensing system having a nozzle for spraying a treating chemistry into the treating chamber to define a spray zone within the treating chamber, the method comprising:

determining a rotational position of the at least one baffle; and spraying the treating chemistry into the treating chamber based on the determined rotational position such that the defined spray zone does not intersect the door.

16. The method according to claim 15 wherein the nozzle for spraying the treating chemistry is located in a front bulkhead such that the defined spray zone does not intersect the door.

17. The method according to claim 16 wherein the nozzle for spraying the treating chemistry is located above the door in the front bulkhead.

18. The method of claim 16 wherein the spraying of the treating chemistry further comprises spraying the treating chamber such that the at least one baffle is located outside the defined spray zone.

19. The method according to claim 18 wherein the drum is not rotated during the spraying of the treating chemistry.

20. The method according to claim 18 wherein the drum is rotated during the spraying of the treating chemistry.

21. The method according to claim 18 wherein the spraying step comprises multiple discrete sprayings of the treating chemistry without rotation of the drum.

22. The method according to claim 21 further comprising rotating the drum between each of the multiple discrete sprayings.

23. The method of claim 1 wherein the determining the rotational position comprises determining when the at least one baffle is located out of the defined spray zone.

24. The method of claim 23 wherein the spraying the treating chemistry comprises spraying the treating chemistry when the at least one baffle is located out of the defined spray zone.

* * * * *